US008658588B2

(12) United States Patent
Wortley et al.

(10) Patent No.: US 8,658,588 B2
(45) **Date of Patent: *Feb. 25, 2014**

(54) SELF-ADHESIVE HIGH VISCOSITY CLEANING COMPOSITION

(75) Inventors: Russell B. Wortley, Kenosha, WI (US); Michael E. Klinkhammer, Racine, WI (US); John R. Wietfeldt, Franksville, WI (US); Thomas A. Strash, Kenosha, WI (US); Debra A. Strasser, Franksville, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 11 days.

This patent is subject to a terminal disclaimer.

(21) Appl. No.: 13/374,700

(22) Filed: Jan. 9, 2012

(65) Prior Publication Data

US 2013/0178409 A1 Jul. 11, 2013

(51) Int. Cl.
*C11D 17/00* (2006.01)

(52) U.S. Cl.
USPC ..... 510/403; 510/424; 510/426; 510/473

(58) Field of Classification Search
None
See application file for complete search history.

(56) References Cited

U.S. PATENT DOCUMENTS

2011/0112006 A1* 5/2011 Cobb et al. ..... 510/405

FOREIGN PATENT DOCUMENTS

| | | | |
|---|---|---|---|
| WO | 2009105232 | A1 | 8/2009 |
| WO | 2009105233 | A1 | 8/2009 |
| WO | 2011014240 | A1 | 2/2011 |
| WO | 2011014241 | A1 | 2/2011 |

OTHER PUBLICATIONS

PCT/US2013/020743 International Search Report dated Mar. 14, 2013.

* cited by examiner

*Primary Examiner* — Necholus Ogden, Jr.

(57) ABSTRACT

A composition for cleaning hard surfaces which is self-adhering to a wet or dry hard surface through a plurality of flows of water thereover. The composition is a gel having a viscosity of about 600,000 cP to about 1,500,000 cP and is capable of being manually applied, i.e., in absence of an applicating dispenser, to a hard surface. The gel composition with high viscosity provides for continuous cleaning until depletion, or may be used for one-time cleaning at any time between application of the composition to a hard surface and depletion of the gel composition.

20 Claims, No Drawings

SELF-ADHESIVE HIGH VISCOSITY CLEANING COMPOSITION

CROSS REFERENCE TO RELATED APPLICATIONS

This application claims benefit of U.S. Ser. No. 12/461,102 filed Jul. 31, 2009 and now U.S. Pat. No. 8,143,206 B2, which in turn claims benefit of U.S. Ser. No. 12/388,576 filed Feb. 19, 2009 and now U.S. Pat. No. 8,143,205 B2, which in turn claims benefit of Provisional Application No. 61/064,182 filed Feb. 21, 2008; each of these named applications being incorporated herein by reference.

FIELD OF INVENTION

The particular invention as described herein relates to gel cleaning compositions for hard surfaces which self-adhere to a hard surface to which it is applied and is suitable for use in a continuous cleaning mode or as a manual cleaner. The compositions have a ultra-high viscosity that allows the composition to be applied to a wet or dry hard surface without the need of an applicating dispenser. The physical nature of the compositions further allow for dispersal of a portion of the composition upon passage of water thereover to provide extended spreading or coating of the hard surface surrounding the applied composition to provide immediate and residual cleaning benefits. Suitable hard surfaces on which the compositions are useful include, for example, a ceramic surface such as toilet bowls, glass windows, doors, shower or bath walls, and the like.

BACKGROUND OF THE INVENTION

Various cleaning compositions for attachment directly or indirectly to hard surfaces are known. The compositions can be in the form of a solid, gel or liquid. Gel and liquid cleaning compositions need a dispenser or applicator to apply or position the composition on a surface to be cleaned which increases the expense of the overall product and requires storage of the dispenser/applicator between uses. An example of a self-adherent composition for a toilet bowl is described in U.S. Pat. No. 6,667,286. The composition is stated to have a viscosity of at least 15,000 mPas, at least 60,000 mPas, or at least 150,000 mPas. A solid composition does not necessarily require an applicator, but due to its solid nature requires a dry surface to obtain adhesion to a hard surface, and such composition does not provide for the same degree or amount and speed of dispersal of cleaning components upon an individual flow of water thereover, although such generally lasts longer than a low viscosity gel.

Further, such products as described above are intended for a single mode of use, i.e., such are applied to a surface for continuous use until the product is depleted.

The present invention overcomes these difficulties. The composition of the present invention is adherable to a wet or dry hard surface and does not require the use of an applicating dispenser for adhesion of the composition to a hard surface.

SUMMARY OF INVENTION

The cleaning composition of the present invention is a gel having a ultra-high viscosity of about 600,000 cP to about 1,500,000 cP (centipoise). The cleaning composition can be applied by a user to a desired hard surface without the need of an applicating dispenser. The gel can be provided in various forms or shapes, for example strips, circles, patches of differing design configurations, etc. The cleaning composition is especially useful as a toilet bowl cleaner. The benefits of the composition are particularly evident with such use. Therefore, for ease of discussion, the description of the invention will be provided primarily in terms of a toilet bowl cleaner without limiting the invention thereto since other modes of use are also described herein.

The cleaning composition components provide for the desired physical properties and cleaning properties, including providing for stability and good dispersal of the cleaning components to the hard surface to which the composition is applied upon the passage of water over the composition so as to provide both an immediate cleaning effect and residual cleaning benefit. The composition provides a Marangoni effect in the spreading of the cleaning composition and the providing of transportation of the cleaning components at a consistent and repeated transport rate over the life of the cleaning composition and during repeated dispersals of portions of the composition based on repeated separate flows of water over the composition adhered to a hard surface. Thus, the composition provides for continuous cleaning of a surface over an extended period of time. Additionally, the composition can serve as a manual cleaning composition either after initial use as a continuous cleaning composition but prior to depletion, or as an initial use.

The cleaning composition is aqueous based and includes water, at least one nonionic surfactant, a polyalcohol, a film-forming hydrophilic polymer, a non-polar hydrocarbon such as mineral oil, a second nonionic surfactant in addition to the at least one nonionic surfactant wherein the second nonionic surfactant comprises a blend of non-ethoxylated linear primary alcohols or blend of ethoxylated linear primary alcohols wherein the alcohols of each blend include a carbon chain of 9 to 17 carbons. The composition in a preferred embodiment includes at least one anionic surfactant. The composition may also optionally include suitable adjuvants such as fragrance (s), colorant(s), preservative(s), solvent(s), acid(s), abrasive (s), and the like, so long as such do not detrimentally affect the high viscosity of the composition.

More particularly, one preferred embodiment of the cleaning composition has a viscosity in a range of about 600,000 cP to about 1,500,000 cP and includes (1) about 7.5 wt. % to about 20 wt. % of at least one anionic surfactant, (2) about 20 to about 80 wt. % of at least one nonionic surfactant, (3) greater than 0 to about 10 wt. % polyalcohol, (4) about 0.5 to about 10 wt. % of a film-forming polymer, (5) about 1 to about 5 wt. % of a non-polar hydrocarbon such as mineral oil, (6) greater than 0 to about 2 wt. % of a second nonionic surfactant comprising a blend of non-ethoxylated linear primary alcohols or blend of ethoxylated linear primary alcohols wherein the alcohols of each blend include a carbon chain of 9 to 17 carbons, and (7) a balance of water and optional adjuvants, such as fragrance(s), colorant(s), preservative(s), acid(s), abrasive(s), and solvent(s).

In use, the cleaning composition of high viscosity is applied manually, i.e., in the absence of an applicating dispenser, to a desired hard surface, preferably a toilet bowl. The surface can be wet or dry. The composition can be left in place to provide continuous cleaning of the surrounding surface. When water is caused to flow over the composition, a portion of the composition is caused to disperse from the composition in a 360° spread direction, i.e., with the flow of water as well against the flow of water, to provide a coating or film on the surface for immediate cleaning effect and residual cleaning benefit, i.e., so that subsequent soil is prevented from directly adhering to the surface thereby allowing ready removal therefrom by subsequent rinsing. Alternatively, the composition once adhered to the surface, may immediately or after an elapsed period of time of continuous cleaning be used as a manual cleaning composition. Manual cleaning is provided by use of a brush, sponge or the like to spread the cleaning composition over the surface for immediate concentrated cleaning and depletion of the composition.

Some advantages provided by the invention, without being limited thereto, include: ability for use as a continuous and manual cleaning composition eliminating the need for two separate products, reduced packaging and need for less storage space since no applicating dispenser is required, increased efficiency without sacrificing safety, more convenient since can use as continuous cleaner and then ready for immediate manual cleaning because composition is already in place of use, and can add an abrasive component to increase both cleaning benefit and adherence of the composition to a surface.

DETAILED DESCRIPTION OF THE INVENTION

Definitions

As used herein, "composition" refers to any substance having more than one component.

As used herein, "self-adhesive" or "self-adhering" refers to the ability of a composition to stick onto a hard surface without the need for a separate adhesive or other support device. In one embodiment, a self adhesive composition does not leave any residue or other substance (i.e., additional adhesive) once the composition is used up.

As used herein, "gel" is neither a conventional solid nor conventional liquid, but rather refers to a disordered solid composed of a liquid with a network of interacting particles or polymers which has a non-zero yield stress. The viscosity of the gel does not need to be 100% homogenous throughout the gel, but will be within the disclosed range, i.e., about 600,000 cP to about 1,500,000 cP, at any point in the gel.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of ingredient in the total formula wherein the total formula equals 100 wt. %. For example, a component which is 10% actives is described as being present in the composition in an amount of 1 wt. % is present in such amount as to the formula and not as based on actives which would be 0.1 wt. % actives (i.e., 10% of 1 wt. %).

As used herein, "hard surface" refers to any porous and/or non-porous surface. In one embodiment, a hard surface may be selected from the group consisting of: ceramic, glass, metal, polymer, stone, and combinations thereof. In another embodiment, a hard surface does not include silicon wafers and/or other semiconductor materials. Nonlimiting examples of ceramic surfaces include: toilet bowl, sink, shower, tile, the like, and combinations thereof. A nonlimiting example of a glass surfaces includes: window and the like. Nonlimiting examples of metal surfaces include: drain pipe, sink, automobiles, the like, and combinations thereof. Nonlimiting examples of a polymeric surface includes: PVC piping, fiberglass, acrylic, Corian®, the like, and combinations thereof. A nonlimiting example of a stone hard surface includes: granite, marble, and the like.

A hard surface may be any shape, size, or have any orientation that is suitable for its desired purpose. In one nonlimiting example, a hard surface may be a window which may be oriented in a vertical configuration. In another nonlimiting example, a hard surface may be the surface of a curved surface, such as a ceramic toilet bowl. In yet another nonlimiting example, a hard surface may be the inside of a pipe, which has vertical and horizontal elements, and also may have curved elements. It is thought that the shape, size and/or orientation of the hard surface will not affect the compositions of the present invention because of the unexpectedly strong transport properties of the compositions under the conditions described infra.

As used herein, "surfactant" refers to any agent that lowers the surface tension of a liquid, for example water. Exemplary surfactants which may be suitable for use with the present invention are described infra.

In use, the composition of the invention may be applied directly on a wet or dry hard surface to be treated, e.g. cleaned, such as a toilet bowl, shower or bath enclosure, drain, window, or the like, and self-adheres thereto, including through a plurality of flows of water passing over the self-adhering composition and surface, e.g. flushes, showers, rinses or the like. Each time water flows over the composition, a portion of the composition is released into the water that flows over the composition. The portion of the composition released onto the water covered surface provides a continuous wet film to the surface to in turn provide for immediate and long term cleaning and/or disinfecting and/or fragrancing or other surface treatment depending on the active agent(s) present in the composition. It is thought that the composition, and thus the active agents of the composition, may spread out from or are delivered from the initial composition placement in direct contact with the surface to coat continuously an extended area on the surface. The wet film acts as a coating and emanates from the self-adhering composition in all directions, i.e., 360°, from the composition, which includes in a direction against the flow of the rinse water. Motions of the surface of a liquid are coupled with those of the subsurface fluid or fluids, so that movements of the liquid normally produce stresses in the surface and vice versa. The mechanism for the movement of the gel and/or the active ingredients is discussed in greater detail infra.

Composition

The composition has a gel or gel-like consistency. In the described embodiment, the composition is, thus, firm but not rigid as a solid. The gel composition has a viscosity of about 600,000 cP to about 1,500,000 cP which provides the gel composition with a physical stability which allows the provision of the composition in pre-determined sized portions and allows a user to manually place a desired quantity of the gel composition on a hard surface to be cleaned in the absence of an applicating dispenser. Examples of provision of the sized portions for manual placement are (1) the provision of the portion in a thermoformed water soluble tray, and (2) provision of peel-away strips of material on the portion. In the tray embodiment, the open top will initially be sealed with a seal which can be peeled off. Each embodiment is structured to provide at least one side of the composition portion which can be exposed prior to application to a hard surface. The gel composition is then placed for self-adherence to a hard surface by simple manual pressure by the user by pressing the exposed side of the gel composition against the hard surface resulting in the gel composition remaining in such placement, even through a plurality of separate flows of water over the adhered gel composition. In the water-soluble tray embodiment, the tray dissolves off the cleaning composition in a flow of rinse water. In the embodiment with the peel away strips, the strips can be manually removed by peeling or such also can be provided in a water-soluble form.

The improved adhesion obtained by the composition of the invention allows application on a vertical surface without becoming detached through a plurality of streams of rinse water and the gradual washing away of a portion of the composition over time to provide the desired cleaning and/or disinfecting and/or fragrance or other treatment action. Once the composition is completely washed away, nothing remains for removal and more composition is simply applied.

The cleaning composition of high viscosity of the present invention which has a dimensional stability even under the action of rinse water includes, in a preferred embodiment, at least one nonionic surfactant, preferably an ethoxylated alcohol; at least one anionic surfactant, preferably an alkali metal alkyl ether sulfate or sulfonate; a non-polar hydrocarbon, preferably mineral oil; a second nonionic surfactant comprising a blend of non-ethoxylated linear primary alcohols or blend of ethoxylated linear primary alcohols wherein each alcohol of the blends includes a carbon chain containing 9 to 17 carbons (referred to herein for convenience as the "non-ethoxylated linear C9-C17 primary alcohol blend" and the "ethoxylated linear C9-C17 primary alcohol blend", respectively); a polyalcohol; a film-forming hydrophilic polymer; water; and optionally fragrance(s), colorant(s), preservative (s), solvent(s), acid(s) and abrasive(s). The second nonionic surfactant is different from the at least one nonionic surfactant.

The film-forming hydrophilic polymer aids in providing adherence of as well as extends the spreading and, thus, delivery of active agents for treatment of the surface and/or surrounding environment. In some embodiments, the composition may also include a superwetter compound to enhance the spreading of the wet film. The composition displays stability in use without the necessity of an exterior hanging device or holder thereby only requiring a new application of the composition to the surface after a long lapse of time and no need to remove any device. The non-ethoxylated linear C9-C17 primary alcohol blend and ethoxylated linear C9-17 primary alcohol blend each serve to lower the gel temperature of the composition during processing which allows the composition to be processed at a lower temperature which reduces degradation or the chance of degradation of composition components. This is especially applicable to when hot processing is utilized in which case the mineral oil raises the gel temperature. The linear primary alcohol blend serves to bring down the temperature. The inclusion of the non-ethoxylated linear C9-C17 primary alcohol blend or ethoxylated linear C9-C17 primary alcohol blend, therefore, provide for more stable components and, thus, more stable product. A key formulating parameter for the composition of the invention is adhesion. Generally, to improve product performance, the adhesive property of the composition is increased. Upon increase in adhesion, however, the gel point of the composition also increases. It is desired for optimum product performance to keep the gel point balanced minimizing the processing temperature while maintaining the composition's gel structure under and during shipping, storage and use conditions. This is obtained through the inclusion of the linear C9-C17 primary alcohol blend or the ethoxylated linear C9-C17 primary alcohol blend, which serve to reduce or suppress the gel point to a desired value with minimal effect on adhesion, force to actuate and maximum gel viscosity.

The at least one, i.e., first, nonionic surfactant is present in an amount of from about 20 wt. % to about 80 wt. %, preferably from about 20 wt. % to about 60 wt. %, and most preferably in the amount of from about 20 wt. % to about 30 wt. %. One or more nonionic surfactants can be used so as to preferably have an average formula chain length distribution of from 19-20 carbons. Accordingly, a high amount of one nonionic surfactant can be used, or for example two nonionic surfactants can be used wherein one has a higher number carbon chain and one has a lower number carbon chain, e.g., a $C_{22}$ nonionic surfactant and a $C_{16-18}$ nonionic surfactant.

Exemplary nonionic surfactants suitable for use include $C_{20}$-$C_{22}$ alkyl ethoxylate with 18 to 50 ethylene oxide groups (EO). In another embodiment, $C_{20}$-$C_{22}$ alkyl ethoxylate comprise 25 to 35 ethylene oxide groups, preferably as an adhesion promoter and nonionic surfactant.

Additional nonlimiting examples of other nonionic surfactants suitable for use include alkylpolyglycosides such as those available under the tradename GLUCOPON from Henkel, Cincinnati, Ohio, USA. The alkylpolyglycosides have the following formula: $RO—(R'O)_x—Z_n$ where R is a monovalent alkyl radical containing 8 to 20 carbon atoms (the alkyl group may be straight or branched, saturated or unsaturated), 0 is an oxygen atom, R' is a divalent alkyl radical containing 2 to 4 carbon atoms, preferably ethylene or propylene, x is a number having an average value of 0 to 12, Z is a reducing saccharide moiety containing 5 or 6 carbon atoms, preferably a glucose, galactose, glucosyl, or galactosyl residue, and n is a number having an average value of about 1 to 10. For a detailed discussion of various alkyl glycosides see U.S. Statutory Invention Registration H468 and U.S. Pat. No. 4,565,647, which are incorporated herein by reference. Some exemplary GLUCOPONS are as follows (where Z is a glucose moiety and x=0) in Table A.

TABLE A

Exemplary Glucopons

| Product | N | R (# carbon atoms) |
|---|---|---|
| 425N | 2.5 | 8-14 |
| 425LF | 2.5 | 8-14 (10 w/w % star-shaped alcohol added) |
| 220UP | 2.5 | 8-10 |
| 225DK | 2.7 | 8-10 |
| 600UP | 2.4 | 12-14 |
| 215CSUP | 2.5 | 8-10 |

Other nonlimiting examples of nonionic surfactants suitable for use include alcohol ethoxylates such as those available under the trade name LUTENSOL from BASF, Ludwigshafen, Germany. These surfactants have the general formula $C_{13}H_{25}/C_{15}H_{27}—OC_2H_4)_n—OH$ (the alkyl group being a mixture of $C_{13}/C_{15}$). Especially preferred are LUTENSOL AO3 (n=3), AO8 (n=8), and AO10 (n=10). Other alcohol ethoxylates include secondary alkanols condensed with ($OC_2H_4$) such as TERGITOL 15-S-12, a $C_{11}$-$C_{15}$ secondary alkanol condensed with 12 ($OC_2H_4$) available from Dow Surfactants. Another example of a nonionic surfactant suitable for use is polyoxyethylene (4) lauryl ether. Amine oxides are also suitable.

At least one anionic surfactant preferably is present in the composition and is present an amount of from about 7.5 wt. % to about 20 wt. %. The anionic surfactant provides the product with a particularly strong "foaming" characteristic that greatly pleases consumers.

Exemplary anionic surfactants suitable for use include alkali metal $C_6$-$C_{18}$alkyl ether sulfates, e.g. sodium lauryl ether sulfate; α-olefin sulfonates or methyl taurides. Other suitable anionic surfactants include alkali metal salts of alkyl, alkenyl and alkylaryl sulfates and sulfonates. Some such anionic surfactants have the general formula $RSO_4M$ or $RSO_3M$, where R may be an alkyl or alkenyl group of about 8 to about 20 carbon atoms, or an alkylaryl group, the alkyl portion of which may be a straight- or branched-chain alkyl group of about 9 to about 15 carbon atoms, the aryl portion of which may be phenyl or a derivative thereof, and M may be an alkali metal (e.g., ammonium, sodium, potassium or lithium).

The non-polar hydrocarbon, such as mineral oil (preferably highly refined white mineral oil) contributes to the ability to achieve the high viscosity of the present invention. The inclusion of a non-polar hydrocarbon, such as mineral oil, additionally contributes to the compositions increased stability and self-adherence to a hard surface, especially a ceramic surface. The mineral oil is present in an amount of from about 1% by weight to about 5% by weight, based on the total weight of the composition. In one embodiment, mineral oil is present in an amount of from about 1.5% wt. % to about 3.5 wt. %. In another embodiment, mineral oil is present in an amount of from about 1.75 wt. % to about 2.5 wt. %. The amount of mineral oil to be included will depend on the viscosity desired, as well as the adhesion performance of the balance of the formula. As the amount of mineral oil is increased, the viscosity and adhesion of the composition are also increased.

Although the mineral oil provides benefits when used in the composition, it is also thought that the inclusion of the mineral oil in higher amounts without decreasing the amount of surfactant and/or thickener and/or adhesion promoting components will result in the composition being thickened to a degree which makes processing of the composition during manufacture and use difficult because the increased firmness of the composition makes it difficult to process. In manufacture, the processing can be carried out under increased temperatures, but such also increases the cost of manufacture and creates other difficulties due to the increased temperature level.

The non-ethoxylated linear C9-C17 primary alcohol blend or an ethoxylated linear C9-C17 primary alcohol blend is present in an amount greater than 0 wt. % to about 2.0 wt. %, preferably in an amount of from about 0.2 wt. % to about 1.75 wt. %, more preferably in an amount of about 1.0 wt. % to about 1.5 wt. %. The inclusion in the composition of the invention of a blend of non-ethoxylated linear primary alcohols or blend of ethoxylated linear primary alcohols, wherein each alcohol of the blends includes a carbon chain containing 9 to 17 carbons, is beneficial in that such has been found to lower the gel temperature about 2° C. for each 0.1 wt. % of the blend present in the composition. The inclusion of the non-ethoxylated linear C9-C17 primary alcohol blend or ethoxylated linear C9-C17 alcohol blend allows the cleaning product to be produced at a lower temperature which reduces degradation or the chance of degradation of at least some components of the composition which improves stability of the components and, therefore, also the composition. A product with improved cleaning properties due to the enhanced stability of the product components is thereby obtained.

The lowering of the gel temperature by the inclusion of the non-ethoxylated linear C9-C17 primary alcohol blend or ethoxylated linear C9-C17 primary alcohol blend is beneficial since some of the raw materials of the components forming the cleaning composition should not be processed at a temperature above 45° C. Lowering of the gel temperature during processing, thus, reduces any degradation which occurs to such materials during processing resulting in the full component amount and properties thereof being present in the composition produced. This necessarily also provides a more cost-efficient product since higher amounts of these components do not have to be utilized to account for any degradation which would otherwise occur. The inclusion of the non-ethoxylated alcohol blend or ethoxylated alcohol blend allow for improved adhesion to improve product performance by keeping the gel point of the composition suppressed to minimize the composition processing temperature while maintaining the desired gel structure under shipping, storage and use conditions. The blends described herein serve to reduce the gel point to a desired value with minimal effect on the properties of adhesion, force to actuate and maximum gel viscosity.

Nonlimiting examples of non-ethoxylated linear C9-C17 primary alcohol blends suitable for use in the present invention are blends including C12 and C13 alcohols, C9 to C11 alcohols, C12 to C15 alcohols, C14 and C15 alcohols, C11-C13-C15 alcohols, C16 and C17 alcohols and C10 to C12 alcohols; and the ethoxylates of these blends. Such alcohols are commercially available from the Shell Company and are sold under the trademark NEODOL. Examples of the non-ethoxylated linear C9-C17 primary alcohol blends include NEODOL 23, NEODOL 91, NEODOL 25, NEODOL 45, NEODOL 135, NEODOL 67 and NEODOL 1. The generic formula for the alcohols of the blend is $C_nH_{(2n+1)}OH$ wherein n=9-17.

NEODOL ethoxylates suitable for use retain the same description of the parent alcohol followed by a number indicating the average moles of ethylene oxide added, and include, for example, NEODOL 23-1, NEODOL 23-3, NEODOL 23-6.5, NEODOL 23-2, NEODOL 91-8, NEODOL 91-2.5, NEODOL 91-5, NEODOL 91-6, NEODOL 25-2.5, NEODOL 25-3, NEODOL 25-7, NEODOL 25-9, NEODOL 25-5, NEODOL 25-1.3, NEODOL 45-4, NEODOL 45-7, NEODOL 45-6.8 and NEODOL 1-9.

A preferred example of a linear C9-C17 primary alcohol blend suitable for use in the present invention is a blend of C12 and C13 primary alcohols, such as sold under the name NEODOL 23. Typical properties of NEODOL 23 are as follows:

| Property | Value |
|---|---|
| C11 and lower alcohols | <1% m/m |
| C12 alcohol | 41% m/m |
| C13 alcohol | 58% m/m |
| C14 and higher alcohols | <1% m/m |
| Normality | 75 min % m/m |
| Hydroxyl number | 285-294 mg KOH/g |
| Molecular mass | 191-197 g/mol |

The C12-C13 primary alcohol blend is preferably used in an amount of about 1.0 wt. % to about 1.5 wt. %.

As evident from the examples of blends suitable for use as the non-ethoxylated linear C9-C17 primary alcohol blend and ethoxylated blends thereof, small amounts of other linear primary alcohols may be present, such as for example, side products resulting from the manner of providing the blend. The non-ethoxylated linear alcohol blend and ethoxylated linear alcohol blend useful in the composition of the invention includes alcohols having C9-C17 chain lengths as a major component of the blend which together provides a majority of the alcohols present. No non-linear alcohols are present in the blend.

The polyalcohol component of the composition is present in an amount of greater than 0 wt. % to about 10 wt. %, preferably greater than 0 wt. % to about 5 wt. %. A preferred polyalcohol is glycerine. Other polyalcohols suitable for use include, for example, polyoxyethylenes.

Suitable film-forming hydrophilic polymers for use in the cleaning composition include natural and synthetic polymers, for instance, polyacrylates, polysaccharides, polyvinyl alcohols, or polyvinyl pyrrolidones. These polymers can serve to increase adhesion of the composition. For purposes of obtaining the high viscosity of the present composition, polyacrylates are preferred. Nonlimiting examples of film-forming polymers useful herein include those based on acrylic acid and acrylates, such as, for example, described in U.S. Pat. Nos. 6,593,288, 6,767,410, 6,703,358, 6,569,261 and 7,923,428. Suitable polymers are sold under the trade name of MIRAPOL SURF S by Rhodia. A preferred polymer is MIRAPOL SURF S-500. The polymer is present in an amount of about 0.5 wt. % to about 10 wt. %, preferably about 1 wt. % to about 5 wt. %. More preferably about 1 wt. % to about 2 wt. %.

The composition may be brought to 100 wt. % by water, and optionally ingredients such as fragrance(s), colorant(s), preservative(s), acid(s), abrasive(s), solvent(s), and the like, and combinations thereof. An abrasive included in the gel composition serves to increase the adhesion properties of the composition as well as provide cleaning benefit.

Fragrances and aromatic substances can be included in the composition to enhance the surrounding atmosphere. The gel composition preferably includes less than 6 wt. % fragrance, more preferably greater than 0 wt. % to 6 wt. % fragrance. In another embodiment still, the gel composition comprises from greater than 0 wt. % to about 5 wt. % fragrance, and most preferably the gel composition includes from about 2 wt. % to about 5 wt. % fragrance.

At least one solvent can be optionally present in the composition to assist in blending of surfactants and other liquids. The solvent is present in an amount of from 0 wt. % to about 15 wt. %, preferably from about 1 wt. % to about 12 wt. %, and more preferably in an amount from about 5 wt. % to about 10 wt. %. Examples of solvents suitable for use are aliphatic alcohols of up to 8 carbon atoms; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbon atoms in each alkyl group; and mono- or diesters of alkylene glycols or polyalkylene glycols having up to 6 carbon atoms per glycol group and up to 6 carbon atoms in each ester group. Specific examples of solvents include t-butanol, t-pentyl alcohol; 2,3-dimethyl-2-butanol, benzyl alcohol or 2-phenyl ethanol, ethylene glycol, propylene glycol, dipropylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, glycerin, ethanol, isopropanol, and dipropylene glycol monoacetate. One preferred solvent is polyethylene glycol.

The gel composition according to the present invention with a viscosity of about 600,000 cP to 1,500,000 cP sticks to wet or dry hard surfaces through self-adhesion upon application. The composition is dimensionally stable so that it does not "run" or "drip" through a plurality of streams of water flowing thereover. It is thought that consumers prefer such a composition because the adhesion and shape of the composition remain intact during placement, as well as in use, even through a plurality of water rinses. However, as described supra, when concentrated cleaning is desired, the applied composition may be manually dispersed by use of a brush, sponge or the like to provide immediate cleaning of the surface.

Exemplary compositions are described in Table B, below:

TABLE B

Exemplary Compositions

| INGREDIENTS | EXAMPLE 1 (wt. %) | EXAMPLE 2 (wt. %) |
|---|---|---|
| $C_{22}$ Ethoxylated Alcohol (30 EO) | 15 | 15 |
| $C_{16-18}$ Ethoxylated Alcohol (30 EO) | 12 | 12 |
| Preservative | 0.15 | 0.15 |
| Dionized Water | 43.145 | 43.649 |
| Mineral Oil | 2.2 | 2.2 |
| Glycerine | 5 | 5 |
| MIRAPOL SURF S-500* | 1 | 1 |
| Sodium lauryl ether sulfate (2 EO) (70%) | 15 | 15 |
| NEODOL 23 | 1.5 | 1.0 |
| Fragrance | 5 | 5 |
| Colorant(s) | 0.005 | 0.001 |
| Total Wt. % | 100 Wt. % | 100 Wt. % |

*Aqueous solution of polyacrylates, an amphoteric surfactant.

Transport of Active Ingredients

As described supra, the composition of the invention may be applied directly on the surface of a sanitary object to be cleaned, such as a toilet bowl, shower or bath enclosure, or the like, and self-adheres thereto through a plurality of streams of water flowing over the self-adhering composition, e.g. flushes or showers. Each time water flows over the composition, a portion of the composition is released onto the surface to which the composition adheres as well as into the water to provide long term cleaning, disinfecting, fragrancing, stain prevention, surface modification, UV protection, whitening, bleaching, and the like. It is thought that any residual benefits may be obtained from the composition through the inclusion of ingredients described above which provide for the spreading and/or transport of the composition along the hard surface to areas wherein the composition was not originally deposited. More specifically, the composition, and thus the active agents of the composition, spread out from or are delivered from the initial composition placement in direct contact with the surface to coat an extended adjoining area on the surface. Motions of the surface of a liquid are coupled with those of the subsurface fluid or fluids, so that movements of the liquid normally produce stresses in the surface and vice versa. The movement of the surface and of the entrained fluid(s) caused by surface tension gradients is called the Marangoni effect (IUPAC Compendium of Chemical Terminology, 2nd Edition, 1994). Thus, the composition of the invention provides that liquid flows along a liquid-air interface from areas having low surface tension to areas having higher surface tension. The Marangoni flow is macroconvection, i.e., the gradient in the interfacial tension is imposed on the system by an asymmetry, as opposed to microconvection where the flow is caused by a disturbance that is amplified in time (an instability). Thus, upon a flow of water over the composition of the invention, the composition spreads outward to cover extended adjoining surface areas as opposed to only the local area covered by or immediately adjacent the composition.

More specifically, it is thought that this effect is observed due to mass transfer on, or in, a liquid layer due to differences in surface tension on that liquid layer. Without wishing to be limited by theory, it is thought that because a liquid with a relatively high surface tension pulls more strongly on the surrounding liquid compared to a liquid with a relatively low surface tension, a surface tension gradient will cause liquid to flow away from regions of relatively low surface tension towards regions of relatively high surface tension. Such property, the Marangoni effect, is used in high-tech semiconductor wafer processing. Nonlimiting examples include U.S. Pat. Nos. 7,343,922; 7,383,843; and 7,417,016.

Those of skill in the art will appreciate that a dimensionless unit often referred to as the Marangoni number may be used to estimate the Marangoni effect, and other transport properties, of a material. One of the factors which may be used to estimate the Marangoni effect of a material, the Marangoni number, may be described by Eq. 1. One of skill in the art will appreciate that the Marangoni number provides a dimensionless parameter which represents a measure of the forces due to surface tension gradients relative to viscous forces.

Marangoni number, $$M_a = -\Gamma(d\sigma/dc)/D\mu$$

Where $M_a$ is the Marangoni number $\Gamma$ is the surface excess concentration of surfactant (mol/$m^2$)

$\sigma$ is the surface tension (N/m)

c is the bulk surfactant concentration (mol/$m^3$)

$\mu$ is the bulk dynamic viscosity (Pascal seconds)

D is the bulk surfactant diffusion coefficient ($m^2$/s)

As described supra, there exist a number of compositions that are used to transport active ingredients around a surface. However, most of the aforementioned compositions rely on gravity or the adhesion-cohesion of liquids as the lone mechanisms for transporting the composition around the surface. Similarly, traditional liquid bathroom cleaners or similar compositions in the bath cleaning arts, for example, often require the user to use a brush, other implement, to manually spread the composition around the surface.

One of skill in the art will appreciate that the transport mechanism described above may be used with any hard surface that is provided with a liquid layer and is not necessarily limited to use in a toilet bowl. For example, it is hypothesized that a user may be able to provide a composition to the surface of a sink, window, drain, or any other hard surface on which water, or other liquid, may be provided. Additional exemplary surfaces are described throughout.

The product is capable of covering an extended area outward 360° from the area of initial product application. Further, the composition may provide an initial and/or further residual treatment of a surface. The speed of spreading is significant since the extent of spreading as desired must be complete prior to drying of the water on the surface since the water is a necessary component in providing the continuous film.

Method of Use

As described above, the present invention compositions may be used to provide immediate and/or residual benefits to a hard surface upon application to that surface wherein the surface will be subject to water or some other liquid which will provide a layer for a surface energy gradient.

In one embodiment, the present invention composition may be comprised of the following steps: (1) application of one or more doses of the composition onto a hard surface; and (2) exposure of the hard surface, and subsequently the one or more doses of composition, to a liquid layer to provide a spread out and dissipated composition layer. The method for using the product may further comprise the optional steps: (3) exposure of the hard surface, and subsequently the spread out and dissipated composition layer to a liquid layer to provide a further spread out and dissipated composition layer. One of skill in the art will appreciate that (3) may be repeated indefinitely until the composition is completely dissipated. In some embodiments, the liquid layer is water.

As described supra, the hard surface may be selected from the group consisting of: ceramic, glass, metal, polymer, fiberglass, acrylic, stone, the like and combinations thereof.

A liquid layer may be provided through any means that is suitable for the intended function. For example, in a toilet bowl, a dose of composition may be applied to the inside surface of the toilet bowl (a ceramic hard surface) and the toilet may be flushed to provide the liquid layer that is necessary to facilitate the transport of the composition around the toilet bowl. In another example, a dose of composition may be applied to the outside surface of a window. The outside surface of the window may be sprayed with water by the user using a hose or power washer, or rain may deposit a layer of water to the window. In yet another example, a dose of composition may be applied to the inside of a sink or drain pipe. The user may simply activate the faucet to provide a layer of water to the sink or drain pipe. In still another example, a dose of composition may be applied to the wall of a shower. The user may activate the shower to provide a liquid layer to the surface. In yet another example, it is envisioned that the liquid layer may also be provided with steam or a relatively high humidity.

The gel composition of the present invention having a high viscosity of about 600,000 cP to about 1,500,000 cP provides added variations in use. Most notably, the gel composition can be provided in a predetermined amount, shape, etc. and applied to a hard surface manually without the need for an applicating disperser. The composition can be provided in a predetermined dose amount in a water-soluble tray, with peel-away strips, or the like, so that a user may provide placement without contacting the composition, but may expose one surface thereof which will provide adherence of the composition to a hard surface. This saves on cost of manufacture and, thus, cost to a consumer since a dispenser device is not necessary which results in the need for less packaging. Additionally, less storage space is needed at both the point of sale and for storage during non-use by a consumer. The high viscosity gel composition also lends itself to either continuous cleaning upon application to a hard surface and partial release over time upon passage of rinse water over the composition and surface, as well as immediate use upon application to a surface or after an elapse of a period of time of continuous use but prior to depletion. In the latter case, a brush, sponge or the like is used to move the gel composition over the hard surface for a concentrated one-time cleaning of the surface.

One of skill in the art will appreciate that the different applications and embodiments of the present invention composition may be provided with different active ingredients or benefit agents which may vary depending on the desired application.

Surface Spreading

The compositions of the present invention with the high viscosity of about 600,000 cP to about 1,500,000 cP provide the benefit of, inter alia, increased mobility and transport. The compositions of Examples 1 and 2 as described above in Table B were tested for surface spreading using the "Surface Spreading Method" described below.

The compositions of Examples 1 and 2 had a transport rate factor of less than 50 seconds, in particular less than about 46 seconds.

Results for the surface spreading (Transport Rate Factor) of a product is reported in Table C below. The Transparent Rate Factor is provided in seconds (time).

The surface spreading of a product is measured by the Surface Spreading Test described below.

TABLE C

| Example 1 | | Example 2 | |
|---|---|---|---|
| Run 1 | Run 2 | Run 1 | Run 2 |
| 41 | 44 | 45 | 44 |
| 43 | 31 | 38 | 41 |
| 50 | 30 | 38 | 47 |
| 58 | 34 | 49 | 49 |
| 40 | 33 | 49 | 52 |
| 46 | 44 | 42 | 46 |
| 52 | 38 | 43 | 46 |
| 33 | 57 | 42 | 44 |
| 48 | 50 | 45 | 39 |
| 38 | 34 | 47 | 43 |
| Avg 44.9 | Avg 39.5 | Avg 43.8 | Avg 45.1 |

Surface Spreading Test

The "transport rate factor" is measured as described below.

A 12"×12" pane of frosted or etched glass is mounted in a flat-bottomed basin that is large enough to support the pane of glass. The basin is provided with a means for drainage such that water does not accumulate on the surface of the pane of glass as the experiment is performed at a room temperature of approximately 22° C. in ambient conditions. The pane of glass is supported on top of the bottom of the basin of water using 4"×4" ceramic tiles—one tile at each side of the bottom edge of the pane. The middle 4 inches of the pane is not touching the bottom, so that water can run down and off the glass pane. The pane of glass is juxtaposed such that pane of glass is at an angle of approximately 39° from the bottom of the basin.

The glass pane is provided with 0.5 inch measurement markers from a first edge to the opposing edge.

A glass funnel (40 mm long×15 mm ID exit, to contain>100 ml) is provided approximately 3.5" over the 9" mark of the pane of glass.

The pane of glass is cleaned with room temperature water to remove trace surface active agents. The cleaned pane of glass is rinsed until there is no observable wave spreading on the pane.

A sample of approximately 7 g. (approximately 1.5" diameter circle for gels) of composition is applied to the pane of glass at the 0 mark. Four beakers (approximately 200 mL each) of water (are slowly poured over the top of the glass pane at the 9" height point and is allowed to run down the pane of glass to condition the composition.

After about one minute, the funnel is then plugged and is provided with approximately 100 mL of water. An additional 100 mL of water is slowly poured onto the glass pane at approximately the 9" marker. After approximately 10 seconds, the stopper is removed and a timer is started as the water in the funnel drains onto the pane of glass.

A wave on the surface of the draining water film above the composition is observed to creep up the glass and the time for the composition to reach the 5" marker is recorded.

The test is repeated for 10 replicates and the time in seconds is averaged and reported as the "transport rate factor" (time in seconds).

Additional examples of compositions of the present invention are set forth below in Table D as Examples 3 through 6.

TABLE D

| INGREDIENTS | EX. 3 (wt. %) | Ex. 4 (wt. %) | Ex. 5 (wt. %) | Ex. 6 (wt. %) |
|---|---|---|---|---|
| Deionized Water | 45.00 | 45.00 | 44.80 | 43.80 |
| Sodium lauryl ether sulfate 2 EO, 70% | 15.00 | 15.00 | 15.00 | 15.00 |
| Imbentin AG/618 | 13.00 | 13.00 | 13.00 | 13.00 |
| Imbentin AG/168S/300 SP | 13.00 | 13.00 | 13.00 | 13.00 |
| Glycerine, USP 99.5% | 5.00 | 5.00 | 5.00 | 5.00 |
| Fragrance | 5.00 | 5.00 | 5.00 | 5.00 |
| Mirapol Surf S-500 Rhodia 22% active | | | | 1.00 |
| White Mineral Oil, Highly Refined | 2.00 | 2.00 | 2.20 | 2.20 |
| Neodol 23 | 1.00 | 1.00 | 1.00 | 1.00 |
| HEC QP 52000* | 1.00 | 0.50 | 1.00 | 1.00 |
| (CMC)carboxymethyl cellulose | | 0.50 | | |
| Total Wt. % | 100 | 100 | 100 | 100 |
| Gel Temperatures | 67 | 69.7 | 69.8 | 71.1 |
| Max. Viscosity (cP) | 655000 | 666000 | 940000 | 689000 |

*Hydroxyethyl cellulose

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A cleaning composition comprising (a) at least one nonionic surfactant;

(b) at least one polyalcohol;

(c) at least one hydrophilic polymer;

(d) mineral oil;

(e) a non-ethoxylated blend of linear primary alcohols wherein each alcohol of said non-ethoxylated blend includes a carbon chain containing 9 to 17 carbons, or an ethoxylated blend of linear primary alcohols wherein each alcohol includes a carbon chain containing 9 to 17 carbons; and (f) water wherein said composition is a gel having a viscosity of about 600,000 cP to about 1,500,000 cP, wherein said non-ethoxylated blend and said ethoxylated blend of (e) are different from said at least one nonionic surfactant, and wherein said composition is self-adhering to a hard surface and is composed to remain self-adhering to said hard surface through a plurality of flows of water thereover, and provides a Marangoni effect resulting in spreading of components of the cleaning composition.

2. The cleaning composition of claim 1, further comprising about 20 wt. % to about 80 wt. % of said at least said first nonionic surfactant and said second nonionic surfactant;

greater than 0 wt. % to about 10 wt. % polyalcohol;

about 0.5 wt. % to about 10 wt. % of said hydrophilic polymer;

about 1.0 wt. % to about 5 wt. % of said mineral oil;

greater than 0 wt. % to about 2 wt. % of said blend of linear primary alcohols of (e); and a balance of said water.

3. The cleaning composition of claim 1, wherein said at least one nonionic surfactant of (a) comprises a first nonionic surfactant which is an ethoxylated alcohol having a carbon chain with 20 to 22 carbons and 18 to 50 ethylene oxide groups and a second nonionic surfactant which is an ethoxylated alcohol having a carbon chain with 11 to 18 carbons and 1 to 50 ethylene oxide groups.

4. The cleaning composition of claim 2, wherein said at least one nonionic surfactant of (a) comprises a first nonionic surfactant which is an ethoxylated alcohol having a carbon chain with 20 to 22 carbons and 18 to 50 ethylene oxide groups and a second nonionic surfactant which is an ethoxylated alcohol having a carbon chain with 11 to 18 carbons and 1 to 50 ethylene oxide groups.

5. The cleaning composition of claim 1, wherein said polymer is a polyacrylate.

6. The cleaning composition of claim 2, wherein said polymer is a polyacrylate.

7. The cleaning composition of claim 2, wherein said mineral oil is present in an amount of from about 1 wt. % to about 2.5 wt. %.

8. The composition of claim 1, wherein said composition is adapted for direct application to said hard surface manually in absence of an applicating dispenser.

9. The composition of claim 2, wherein said composition is adapted for direct application to said hard surface manually in absence of an applicating dispenser.

10. The cleaning composition of claim 1, wherein following application of said cleaning composition to said hard surface, either immediately or after a pre-determined elapsed period of time, said composition can be manually moved over said hard surface to obtain cleaning of said hard surface.

11. The cleaning composition of claim 2, wherein following application of said cleaning composition to said hard surface, either immediately or after a pre-determined elapsed period of time, said composition can be manually moved over said hard surface to obtain cleaning of said hard surface.

12. A cleaning composition comprising (a) a nonionic ethoxylated alcohol having a carbon chain length of 20 to 22 carbons and 18 to 50 ethylene oxide groups, (b) a nonionic fatty ethoxylated alcohol having a carbon chain length of equal to 11 to 18 carbons and 1 to 50 ethylene oxide groups, (c) an alkali metal alkyl ether sulfate, (d) a polyalcohol, (e) a film-forming hydrophilic polyacrylate, (f) mineral oil, (g) a blend of linear primary alcohols having a carbon chain length of from 9 to 17 carbons, and (h) water, wherein said composition is a gel having a viscosity of about 600,000 cP to about 1,500,000 cP, and wherein said composition is self-adhering to a hard surface and is composed to remain self-adhering to said hard surface through a plurality of flows of water thereover, and provides a Marangoni effect resulting in spreading of components of the cleaning composition.

13. The composition of claim 12, wherein said composition is adapted for direct application to said hard surface manually in absence of an applicating dispenser.

14. The cleaning composition of claim 12, wherein following application of said cleaning composition to said hard surface, either immediately or after a pre-determined elapsed period of time, said composition is manually movable over said hard surface to obtain cleaning of said hard surface.

15. The cleaning composition according to claim 1, further comprising at least one anionic surfactant.

16. The cleaning composition according to claim 2, further comprising about 7.5 wt. % to about 20 wt. % of said at least one anionic surfactant.

17. The cleaning composition according to claim 1, wherein said polymer is hydroxyethyl cellulose.

18. The cleaning composition according to claim 2, wherein said polymer is hydroxyethyl cellulose.

19. The cleaning composition of claim 15, wherein said at least one anionic surfactant is an alkali metal salt of an alkyl ether sulfate or sulfonate.

20. The cleaning composition of claim 16, wherein said at least one anionic surfactant is an alkali metal salt of an alkyl ether sulfate or sulfonate.

* * * * *